US005888347A

United States Patent [19]

Engel et al.

[11] Patent Number: 5,888,347

[45] Date of Patent: Mar. 30, 1999

[54] METHOD FOR MAKING SMOOTH UNCREPED THROUGHDRIED SHEETS

[75] Inventors: Steven Alexander Engel, Neenah; Michael John Rekoske; Theodore Edwin Farrington, Jr., both of Appleton, all of Wis.; Stephen John Sudall, Clwyd, Wales; Paul Edward Williams, Chester, England; David Arthur Hyland, Clwyd, United Kingdom

[73] Assignee: Kimberly-Clark World Wide, Inc., Neenah, Wis.

[21] Appl. No.: 850,884

[22] Filed: May 2, 1997

Related U.S. Application Data

[63] Continuation of Ser. No. 330,166, Oct. 27, 1994, Pat. No. 5,667,636, which is a continuation-in-part of Ser. No. 36,649, Mar. 24, 1993, abandoned.

[51] Int. Cl.[6] ..... D21H 13/00

[52] U.S. Cl. ..... 162/117; 162/363

[58] Field of Search ..... 162/111–113, 123, 162/117, 364, 155, 297, 363, 109, 207; 428/153, 154

[56] References Cited

U.S. PATENT DOCUMENTS

| | | | |
|---|---|---|---|
| 3,301,746 | 1/1967 | Sanford et al. | 162/113 |
| 3,537,954 | 11/1970 | Justus | 162/305 |
| 3,629,056 | 12/1971 | Forrest | 162/305 |
| 3,692,622 | 9/1972 | Dunning | 161/124 |
| 3,726,750 | 4/1973 | Stillings | 161/57 |
| 3,776,807 | 12/1973 | Dunning et al. | 161/124 |
| 3,806,406 | 4/1974 | Ely | 162/206 |
| 3,812,000 | 5/1974 | Salvucci, Jr. et al. | 162/111 |
| 3,821,068 | 6/1974 | Shaw | 162/111 |
| 3,846,228 | 11/1974 | Ely et al. | 162/206 |
| 3,905,863 | 9/1975 | Ayers | 162/113 |
| 3,926,716 | 12/1975 | Bates | 162/113 |
| 3,974,023 | 8/1976 | Ayers | 162/113 |
| 3,994,771 | 11/1976 | Morgan, Jr. et al. | 162/113 |
| 4,072,557 | 2/1978 | Schiel | 162/111 |
| 4,087,319 | 5/1978 | Linkletter | 162/113 |
| 4,100,017 | 7/1978 | Flautt, Jr. | 162/111 |
| 4,102,737 | 7/1978 | Morton | 162/113 |
| 4,120,747 | 10/1978 | Sarge, III et al. | 162/117 |
| 4,125,430 | 11/1978 | Grossman | 162/207 |
| 4,125,659 | 11/1978 | Klowak et al. | 428/153 |
| 4,127,637 | 11/1978 | Pietreniak et al. | 264/114 |
| 4,157,938 | 6/1979 | Clemens et al. | 162/207 |
| 4,191,609 | 3/1980 | Trokhan | 162/113 |
| 4,196,045 | 4/1980 | Ogden | 162/117 |
| 4,309,246 | 1/1982 | Mulit et al. | 162/113 |
| 4,440,597 | 4/1984 | Wells et al. | 162/111 |
| 4,448,638 | 5/1984 | Klowak | 162/111 |

(List continued on next page.)

FOREIGN PATENT DOCUMENTS

| | | |
|---|---|---|
| 0 342 646 | 11/1989 | European Pat. Off. . |
| 0 617 164 | 9/1994 | European Pat. Off. . |
| 1573109 | 7/1969 | France . |
| 2105091 | 5/1972 | Germany . |
| 1 212 473 | 11/1970 | United Kingdom . |
| 2 279 372 | 1/1995 | United Kingdom . |
| 2 288 614 | 10/1995 | United Kingdom . |

OTHER PUBLICATIONS

Modern Pulp and Papermaking, Third Edition, Reinhold Publishing Corp. (New York, N.Y.) pp. 312–313 1957.

*Primary Examiner*—Brenda A. Lamb
*Attorney, Agent, or Firm*—Gregory E. Croft

[57] ABSTRACT

Uncreped throughdried cellulosic webs having improved smoothness and stretch are produced by transferring a newly formed web from the forming fabric to a slower moving, high fiber support transfer fabric, preferably using a fixed gap or kiss transfer in which the forming fabric and the transfer fabric converge and diverge at the leading edge of the transfer shoe. The web is then transferred to a through-drying fabric and throughdried to final dryness, producing a web having an improved softness due to increased surface smoothness.

8 Claims, 4 Drawing Sheets

U.S. PATENT DOCUMENTS

| | | | |
|---|---|---|---|
| 4,464,224 | 8/1984 | Matolcsy | 162/111 |
| 4,469,735 | 9/1984 | Trokhan | 428/154 |
| 4,529,480 | 7/1985 | Trokhan | 162/109 |
| 4,551,199 | 11/1985 | Weldon | 162/109 |
| 4,556,450 | 12/1985 | Chuang et al. | 162/204 |
| 4,637,859 | 1/1987 | Trokhan | 162/109 |
| 4,808,266 | 2/1989 | Faurie | 162/102 |
| 4,940,513 | 7/1990 | Spendel | 162/112 |
| 4,959,125 | 9/1990 | Spendel | 162/158 |
| 5,048,589 | 9/1991 | Cook et al. | 162/109 |
| 5,059,282 | 10/1991 | Ampulski et al. | 162/111 |
| 5,098,519 | 3/1992 | Ramasubramanian et al. | 162/109 |
| 5,098,522 | 3/1992 | Smurkoski et al. | 162/358 |
| 5,126,015 | 6/1992 | Pounder | 162/206 |
| 5,137,600 | 8/1992 | Barnes et al. | 162/115 |

METHOD FOR MAKING SMOOTH UNCREPED THROUGHDRIED SHEETS

This application is a continuation of application Ser. No. 08/330,166 entitled "Method For Making Smooth Uncreped Throughdried Sheets" and filed in the U.S. Patent and Trademark Office on Oct. 27, 1994, now U.S. Pat. No. 5,667,636 which is a continuation-in-part of application Ser. No. 08/036,649 entitled "Method For Making Smooth Uncreped Throughdried Sheets", now abandoned, and filed in the U.S. Patent and Trademark Office on Mar. 24, 1993. The entirety of this Application is hereby incorporated by reference.

BACKGROUND OF THE INVENTION

In the manufacture of paper products such as tissues, towels, wipers and the like, a wide variety of product characteristics must be given attention in order to provide a final product with the appropriate blend of attributes suitable for the product's intended purpose. Among these various attributes, improving surface feel, strength, absorbency, bulk and stretch have always been major objectives. Traditionally, many of these paper products have been made using a wet-pressing process in which a significant amount of water is removed from a wet laid web by pressing or squeezing water from the web prior to final drying. In particular, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping can greatly improve the feel of the web, but at the expense of a significant loss in strength.

More recently, throughdrying has become an alternate means of drying paper webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until dry. The resulting dried web is softer and bulkier than a conventionally-dried uncreped sheet because fewer bonds are formed and because the web is less compressed. Squeezing water from the wet web is eliminated, although the use of a pressure roll to subsequently transfer the web to a Yankee dryer for creping may still be used.

While there is a processing incentive to eliminate the Yankee dryer and make an uncreped throughdried product, uncreped throughdried sheets are typically quite harsh and rough to the touch compared to their creped counterparts. This is partially due to the inherently high stiffness and strength of an uncreped sheet, but is also in part due to the coarseness of the throughdrying fabric onto which the wet web is conformed and dried.

Therefore there is a need for a method for making an uncreped throughdried paper web which can provide improved combinations of sheet properties for a variety of different products.

SUMMARY OF THE INVENTION

It has now been discovered that an improved uncreped throughdried web can be made by transferring the wet web from a forming fabric to one or more intermediate transfer fabrics before further transferring the web to the throughdrying fabric for drying of the web. The intermediate transfer fabric(s) is(are) traveling at a slower speed than the forming fabric during the transfer in order to impart stretch into the sheet. As the speed differential between the forming fabric and the slower transfer fabric is increased (sometimes referred to as "negative draw" or "rush transfer"), the stretch imparted to the web during transfer is also increased. The transfer fabric can be relatively smooth and dense compared to the coarse weave of a typical throughdrying fabric. Preferably the transfer fabric is as fine as can be run from a practical standpoint. Gripping of the web is accomplished by the presence of knuckles on the surface of the transfer fabric. In addition, it can be advantageous if one or more of the wet web transfers, with or without the presence of a transfer fabric, are achieved using a "fixed gap" or "kiss" transfer in which the fabrics simultaneously converge and diverge, which will be hereinafter described in detail. Such transfers not only avoid any significant compaction of the web while it is in a wet bond-forming state, but when used in combination with a differential speed transfer and/or a smooth transfer fabric, are observed to smoothen the surface of the web and final dry sheet.

Hence, in one aspect the invention resides in a method of making a noncompressively-dried cellulosic web comprising: (a) depositing an aqueous suspension of papermaking fibers onto the surface of an endless traveling foraminous forming fabric to form a wet web having a consistency of from about 15 to about 25 weight percent; (b) transferring the wet web to a transfer fabric (hereinafter described) traveling at a speed from about 5 to about 75 percent slower than the forming fabric to impart stretch into the web; and (c) transferring the web to a drying fabric, preferably a throughdrying fabric, whereon the web is dried to final dryness in an uncreped state. This method provides a means for producing webs with improved smoothness, stretch and relatively high caliper or thickness, as measured from one side of the web to another, particularly at relatively low basis weights.

When carrying out a rush transfer, the transfer is carried out such that the resulting "sandwich" (consisting of the forming fabric/web/transfer fabric) exists for as short a duration as possible. In particular, it exists only at the leading edge of the vacuum shoe or transfer shoe slot being used to effect the transfer. In effect, the forming fabric and the transfer fabric converge and diverge at the leading edge of the vacuum slot. The intent is to minimize the distance over which the web is in simultaneous contact with both fabrics. It has been found that simultaneous convergence/divergence is the key to eliminating macrofolds and thereby enhances the smoothness of the resulting tissue or other product.

In practice, the simultaneous convergence and divergence of the two fabrics will only occur at the leading edge of the vacuum slot if a sufficient angle of convergence is maintained between the two fabrics as they approach the leading edge of the vacuum slot and if a sufficient angle of divergence is maintained between the two fabrics on the downstream side of the vacuum slot. The minimum angles of convergence and divergence are about 0.5° or greater, more specifically about 1° or greater, more specifically about 2° or greater, and still more specifically about 5° or greater. The angles of convergence and divergence can be the same or different. Greater angles provide a greater margin of error during operation. A suitable range is from about 1° to about 10°. Simultaneous convergence and divergence is achieved when the vacuum shoe is designed with the trailing edge of the vacuum slot being sufficiently recessed relative to the leading edge to permit the fabrics to immediately diverge as they pass over the leading edge of the vacuum slot. This will be more clearly described in connection with the Drawing.

If setting up the machine with the fabrics initially having a fixed gap to further minimize compression of the web during the transfer, the distance between the fabrics should be equal to or greater than the thickness or caliper of the web so that the web is not significantly compressed when transferred at the leading edge of the vacuum slot.

In another aspect, the invention resides in a method of making a noncompressively-dried cellulosic web comprising: (a) depositing an aqueous suspension of papermaking fibers onto the surface of an endless traveling foraminous forming fabric to form a wet web having a consistency of from about 15 to about 25 weight percent; (b) transferring the wet web to a drying fabric, preferably a throughdrying fabric, traveling at a speed from about 5 to about 75 percent slower than the forming fabric by passing the web over a vacuum shoe having a vacuum slot with a leading and trailing edge, wherein the forming fabric and the drying fabric converge and diverge at the leading edge of the vacuum slot at an angle of about 0.5° or greater; and (c) noncompressively drying the web.

In a further aspect, the invention resides in an uncreped, uncalendered throughdried cellulosic web having a Surface Smoothness (hereinafter defined and described in connection with FIG. 3) of about 3200 micro-inches or less, preferably about 2500 micro-inches or less, and more preferably about 1500 micro-inches or less. As hereinafter described, increased smoothness is achieved through the use of the transfer fabric and, preferably, in combination with a fixed gap carrier fabric section following drying. Calendering of the web is not necessary to obtain these levels of smoothness, although it is within the scope of this invention that the smooth webs of this invention be further processed to further enhance the properties of the sheet, such as by calendering, embossing or creping.

The forming process and tackle can be conventional as is well known in the papermaking industry. Such formation processes include Fourdrinier, roof formers (such as suction breast roll), and gap formers (such as twin wire formers, crescent formers) etc. Forming wires or fabrics can also be conventional, the finer weaves with greater fiber support being preferred to produce a more smooth sheet or web. Headboxes used to deposit the fibers onto the forming fabric can be layered or nonlayered.

The basis weights of the webs of this invention can be any weight suitable for use as a paper towel or wiper. Such webs can have a basis weight of from about 15 to about 60 grams per square meter, more suitably from about 20 to about 30 grams per square meter.

As used herein, "transfer fabric" is a fabric which is positioned between the forming section and the drying section of the web manufacturing process. Suitable transfer fabrics are those papermaking fabrics which provide a high fiber support index and provide a good vacuum seal to maximize fabric/sheet contact during transfer from the forming fabric. The fabric can have a relatively smooth surface contour to impart smoothness to the web, yet must have enough texture to grab the web and maintain contact during a rush transfer. Finer fabrics can produce a higher degree of stretch in the web, which is desireable for some product applications.

Transfer fabrics include single-layer, multi-layer, or composite permeable structures. Preferred fabrics have at least some of the following characteristics: (1) On the side of the transfer fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional characteristic; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yarns.

Specific suitable transfer fabrics include, by way of example, those made by Asten Forming Fabrics, Inc., Appleton, Wis. and designated as numbers 934, 937, 939 and 959. The void volume of the transfer fabric can be equal to or less than the fabric from which the web is transferred.

The speed difference between the forming fabric and the transfer fabric can be from about 5 to about 75 percent or greater, preferably from about 10 to about 35 percent, and more preferably from about 15 to about 25 percent, the transfer fabric being the slower fabric. The optimum speed differential will depend on a variety of factors, including the particular type of product being made. As previously mentioned, the increase in stretch imparted to the web is proportional to the speed differential. For an uncreped throughdried three-ply wiper having a basis weight of about 20 grams per square meter per ply, for example, a speed differential in the production of each ply of from about 20 to about 25 percent between the forming fabric and a sole transfer fabric produces a stretch in the final product of from about 15 to about 20 percent.

The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The drying process can be any noncompressive drying method which tends to preserve the bulk or thickness of the wet web including, without limitation, throughdrying, infrared irradiation, microwave drying, etc. Because of its commercial availability and practicality, throughdrying is a well-known and preferred means for noncompressively drying the web. Suitable throughdrying fabrics include, without limitation, Asten 920A and 937A, and Velostar P800 and 103A. The web is preferably dried to final dryness without creping, since creping tends to lower the web strength and bulk.

While the mechanics are not completely understood, it is clear that the transfer fabric and throughdrying fabric can make separate and independent contributions to final sheet properties. For example, sheet surface smoothness as determined by a sensory panel can be manipulated over a broad range by changing transfer fabrics with the same throughdrying fabric. Webs produced via this invention tend to be very two-sided unless calendered. Uncalendered webs may, however, be plied together with smooth/rough sides out as required by specific product forms.

DETAILED DESCRIPTION OF THE INVENTION

Figure 1:
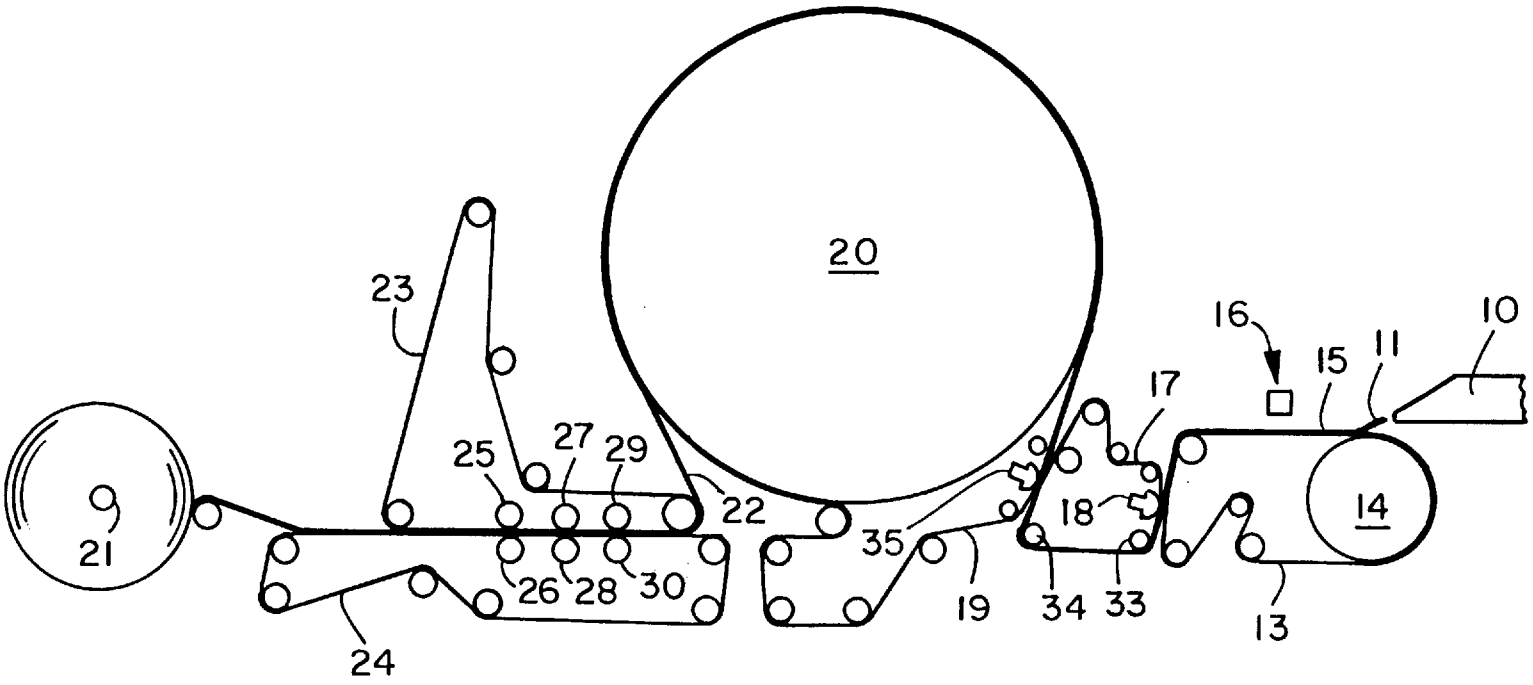
FIG. 1 is a schematic process flow diagram illustrating a method of making uncreped throughdried sheets in accordance with this invention.

Directing attention to the Drawing, the invention will be described in further detail.

FIG. 1 illustrates a means for carrying out the method of this invention. (For simplicity, the various tensioning rolls schematically used to define the several fabric runs are shown but not numbered.) Shown is a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent.

After formation, the forming fabric carries the wet web 15 to an optional hydroneedling station 16 where the web can be hydroneedled to increase its bulk. Suitable means for hydroneedling are disclosed in U.S. Pat. No. 5,137,600 issued Aug. 11, 1992 to Barnes et al. and entitled "Hydraulically Needled Nonwoven Pulp Fiber Web", which is herein incorporated by reference. Such means provide a multiplicity of pressurized water jets which impinge upon the surface of the newly-formed wet web while supported on the forming fabric, causing an increase in the porosity of the web and hence an increase in bulk.

Whether or not the optional hydroneedling operation is used, additional dewatering of the wet web can be carried out, such as by vacuum suction, while the wet web is supported by the forming fabric. The Fourdrinier former illustrated is particularly useful for making the heavier basis weight sheets useful as wipers and towels, although other forming devices can be used.

The wet web is then transferred from the forming fabric to a transfer fabric 17 traveling at a slower speed than the forming fabric in order to impart increased stretch into the web. Transfer is preferably carried out with the assistance of a vacuum shoe 18 as described hereinafter with reference to FIG. 3.

The transfer fabric passes over rolls 33 and 34 before the wet web is transferred to a throughdrying fabric 19 traveling at about the same speed, or a different speed if desired. Transfer is effected by vacuum shoe 35, which can be of the same design as that used for the previous transfer. The web is dried to final dryness as the web is carried over a throughdryer 20.

Prior to being wound onto a reel 21 for subsequent conversion into the final product form, the dried web 22 can be carried through one or more optional fixed gap fabric nips formed between carrier fabrics 23 and 24. The bulk or caliper of the web can be controlled by fabric embossing nips formed between rolls 25 and 26, 27 and 28, and 29 and 30. Suitable carrier fabrics for this purpose are Albany International 84M or 94M and Asten 959 or 937, all of which are relatively smooth fabrics having a fine pattern. Nip gaps between the various roll pairs can be from about 0.001 inch to about 0.02 inch. As shown, the carrier fabric section of the machine is designed and operated with a series of fixed gap nips which serve to control the caliper of the web and can replace or compliment offline calendering. Alternatively, a reel calender can be employed to achieve final caliper or complement off-line calendering.

Figure 2:
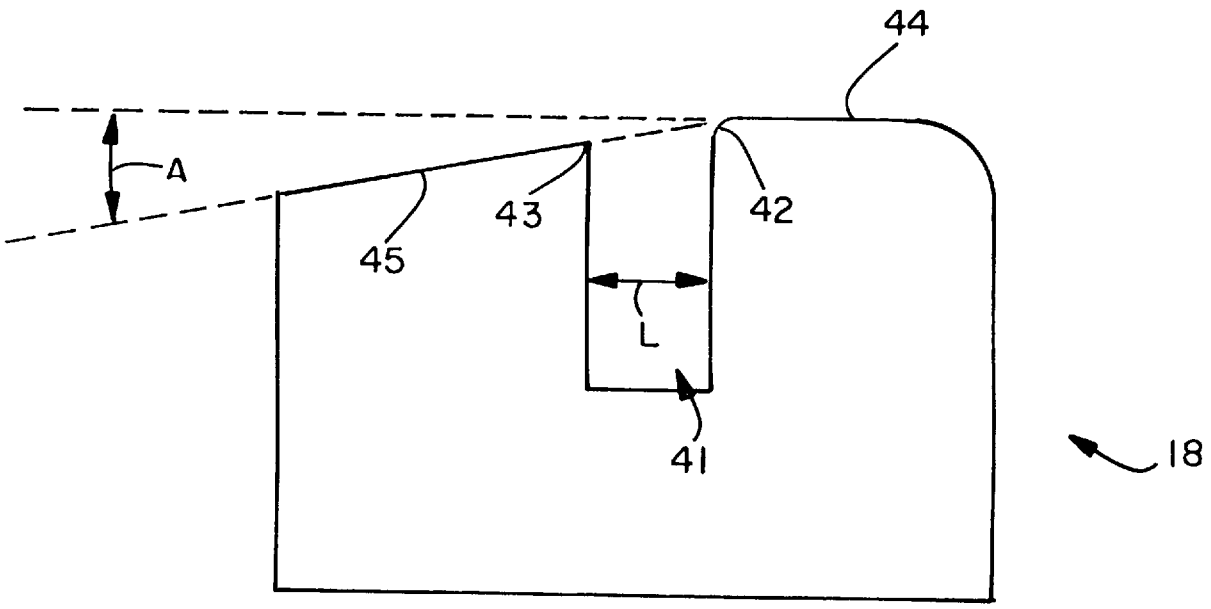
FIG. 2 is a schematic diagram of a transfer shoe useful for carrying out the method of this invention.

FIG. 2 more clearly illustrates the design of the transfer shoe used in the transfer fabric section of the process disclosed in FIG. 1. Shown is the transfer shoe 18 having a vacuum slot 41 having a length of "L" which is suitably connected to a source of vacuum. The length of the vacuum slot can be from about 0.5 to about 1 inch. For producing uncreped throughdried bath tissue, a suitable vacuum slot length is about 1 inch. The vacuum slot has a leading edge 42 and a trailing edge 43. Correspondingly, the transfer shoe has an incoming land area 44 and an outgoing land area 45. Note that the trailing edge of the vacuum slot is recessed relative to the leading edge, which is caused by the different orientation of the outgoing land area relative to that of the incoming land area. The angle "A" between the planes of the incoming land area and the outgoing land area can be about 0.5° or greater, more specifically about 1° or greater, and still more specifically about 5° or greater in order to provide sufficient separation of the forming fabric and the transfer fabric as they are converging and diverging as described below.

Figure 3:
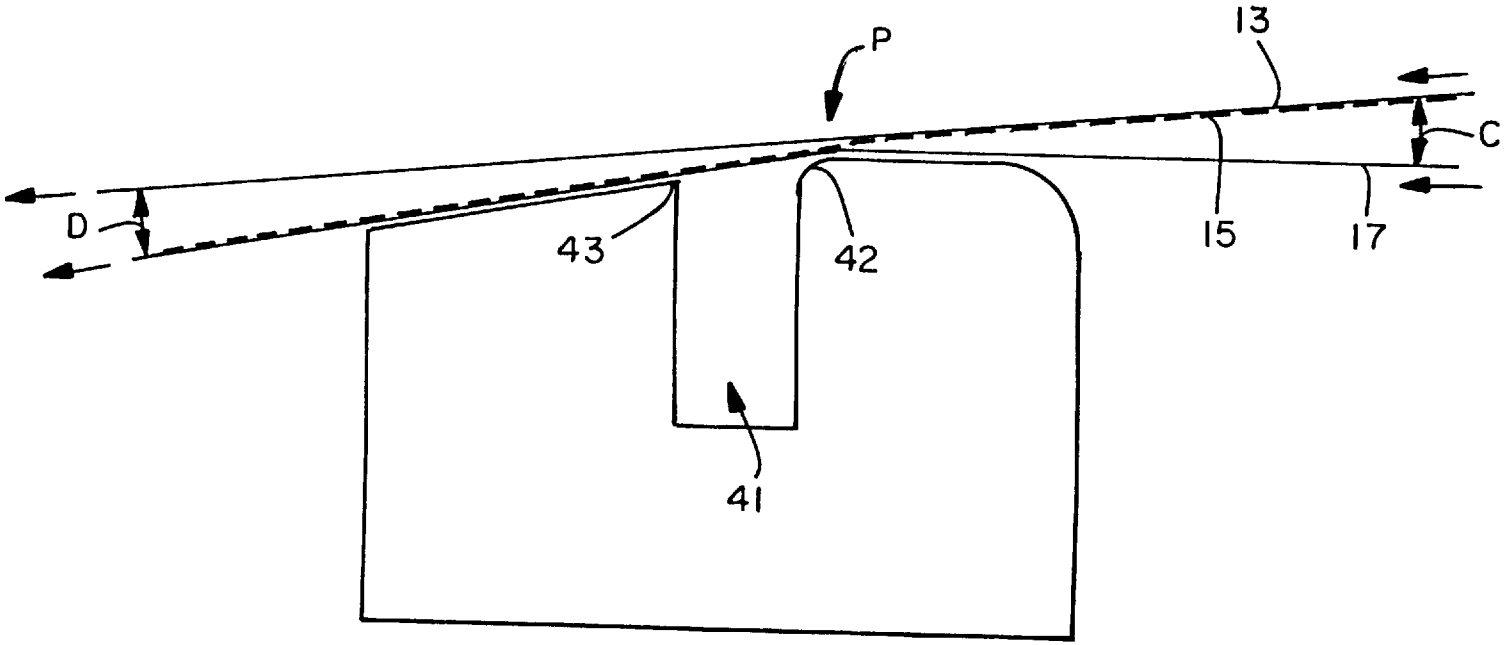
FIG. 3 is a schematic diagram of the transfer section illustrating the simultaneous convergence and divergence of the fabrics at the leading edge of the vacuum slot.

FIG. 3 further illustrates the transfer of the wet tissue web from the forming fabric 13 carrying the wet web 15 as it approaches the transfer shoe traveling in the direction shown by the arrow. Also approaching the transfer shoe is the transfer fabric 17 traveling at a slower speed. The angle of convergence between the two incoming fabrics is designated as "C". The angle of divergence between the two fabrics is designated as "D". As shown, the two fabrics simultaneously converge and diverge at point "P" which corresponds to the leading edge 42 of the vacuum slot. It is not necessary or desireable that the web be in contact with both fabrics over the entire length of the vacuum slot to effect the transfer from the forming fabric to the transfer fabric. As previously described, minimizing the distance during which the web is in contact with both fabrics reduces or eliminates the presence of macrofolds in the resulting tissue. As is apparent from FIG. 3, neither the forming fabric or the transfer fabric need to be deflected more than a small amount to carry out the transfer, which can reduce fabric wear. Numerically, the change in direction of either fabric can be less than 5°.

The surface of the transfer fabric is relatively smooth in order to provide smoothness to the wet web. The openness of the transfer fabric, as measured by its void volume, is relatively low and can be about the same as that of the forming fabric or even lower.

As previously mentioned, the transfer fabric is traveling at a slower speed than the forming fabric. The speed differential is preferably from about 20 to about 30 percent, based on the speed of the forming fabric. If more than one transfer fabric is used, the speed differential between fabrics can be the same or different. Multiple transfer fabrics can provide operational flexibility as well as a wide variety of fabric/speed combinations to influence the properties of the final product.

The level of vacuum used for the differential speed transfers can be from about 3 to about 15 inches of mercury, preferably about 5 inches of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

Figure 4:
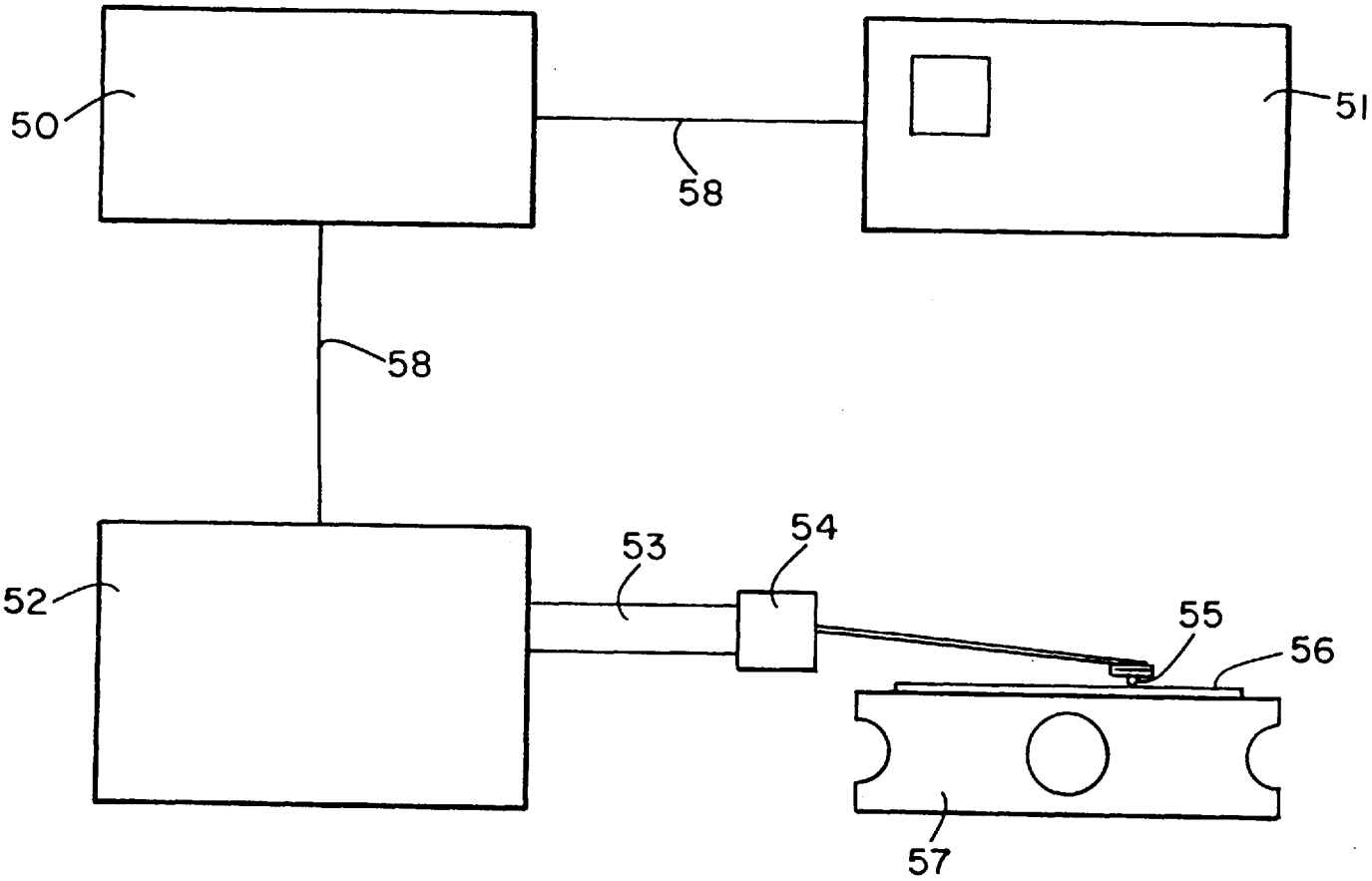
FIG. 4 is a schematic diagram of the equipment set-up for determining the Surface Smoothness of a sample.

Referring now to FIG. 4, the method for determining Surface Smoothness will be described in detail. The Surface Smoothness test measures the smoothness of a surface of a tissue sheet in a way that mimics the response of a human observer gently feeling the surface of the sheet with the fingertips. Either side of the sheet can be measured. The test is based on measurement of the surface profile of a tissue specimen at a nominal angle of 45 degrees with respect to the machine direction of the sheet. The standard deviation of the surface profile is obtained for special frequencies between 2.5 and 22.5 cycles per inch in order to include only those components of surface roughness that are important to human tactile response for tissue, towel or wiper products.

Briefly, the test is based on a surface profile measuring instrument that scans the sheet at a rate of 0.1 inch per second with a 50-milligram tracking force placed on a 0.020 inch diameter ball tip stylus. Since the surface topography of any tissue surface has a high degree of variability, the length of the profile scan line should be greater than 10 inches to ensure statistically valid results. Since standard profile instruments do not have the capability to scan such large distances, the test is based on an instrument that scans approximately 1.5 inches. In order to obtain a larger total scan distance, the test specimen is translated in the direction normal to the profile scanning direction within the plane of the test specimen. This sample translation is done at a speed approximately one-fortieth as fast as the profiling instrument scanning rate. This results in the stylus tracing a zig-zag back and forth across the tissue sheet such that a total path of greater than 10 inches can be obtained without sampling a given position more than once. The output signal of the profile measuring instrument is passed into a signal analyzer where the amplitude information in the frequency range of interest is extracted. This information is integrated into an RMS average number representing the standard deviation of the signal in the frequency range of interest.

The specific test equipment includes:

1) A Federal Products Corporation (of Providence, R.I.) Surfanalyzer System 2000 surface analyzer incorporating a universal probe with a 50-milligram tracking force (part number PMP-31017) coupled to a 0.020 inch ball tip stylus (part number PMP-31132). The probe stylus protector is removed during all testing.
2) A T. S. Products (of Arleta, Calif.) translation table composed of a two-inch translation stage (part number X2), a rotary actuator (part number 1450-2223-548), a controller (part number 1200SC-900), a power supply (part number 1000P) and an interconnecting cable (part number 1200I-10).
3) A Scientific Atlanta, Spectral Dynamics Division (of San Diego, Calif.) model SD380 Signal Analyzer.

Also included is a cable to interconnect the Surfanalyzer with the signal analyzer.

The Surfanalyzer and translation table are mounted on a Newport Corporation (of Fountain View, Calif.) Research Series Table Top (air table) to isolate them from any room floor vibrations. Specifically, the Surfanalyzer is set on this table. The probe translation is switched on until the probe is centered in its translation range. Then, the translation table is placed so that its center is directly under the probe tip. The translation table is carefully aligned so that its axis of movement is orthogonal to the axis of movement of the Surfanalyzer probe.

FIG. 4 illustrates a schematic diagram of the equipment set-up for measuring the Surface Smoothness of a sample. Shown is the Surfanalyzer control unit 50, the SD 380 Signal Analyzer 51, the Surfanalyzer servo unit 52, the translation arm 53, the probe 54, the stylus tip 55, the tissue sample 56 mounted on a glass slide, the translation table 57 with the direction of movement normal to the face of the page, and connecting cables 58.

The equipment described above must be properly configured in order to obtain valid test results. Each piece of equipment is set as follows:

1) Surfanalyzer—The analyzer is first calibrated with the calibration blocks supplied with the instrument, following the procedures in the equipment manuals. Next, the analyzer is leveled, relative to the translation table, by adjusting the coarse and vernier leveling knobs until the instrument shows level to within 10 micro-inches based on a probe scan distance of 1.5 inches. Finally, the controls are set as follows:
   Roughness Cutoff—Set to 0.030 inches;
   Traverse Speed—Set to 0.1 inches per second;
   Sensitivity—Set to 200 micro-inches per division;
   Stylus Travel—Set for 1.5 inches of total;
   Limits travel centered on the available 2-inch range.
2) Translation Table—The speed control is set so that the table moves a distance of 0.90 inches in a period of six minutes as measured with an accurate ruler and a stopwatch. The speed control is then kept in that position during all material testing.
3) Signal Analyzer—The analyzer is set up as follows:
   400 line baseband single-channel spectrum (giving 1024 time domain points). (Note: the active channel can be set for any of the four available channels as long as the signal cable of the Surfanalyzer is physically coupled to the selected channel);
   10 Volt input range with DC coupling;
   10 Hz frequency range;
   Internal sampling source;
   Standard memory operation (NOT extended memory);
   "TIME" operating mode with "TIME and SPECTRUM" sub-mode;
   "Hz" and "Secs" X axis units with linear scaling;
   "Volts" Y axis units with linear scaling and "2X" digital gain;
   Dual display mode with upper trace displaying input (time domain) memory and lower trace displaying average spectrum data;
   80 dB viewing window;
   "Hanning" spectral processing window;
   "Data Averager" set for spectral data, "Sum" mode, "Stop on Time" of 120 seconds;
   Cursor mode set for "delta P" with a range of 0.25 to 2.25 Hz.

The SD380 Signal Analyzer has many other "controls", the setting of which is not consequential to this test.

Samples for the Surface Smoothness test must be properly mounted to a glass microscope slide in order to obtain meaningful results. Specifically, samples are placed on a clean Corning Micro-Slide, Number 2947, 3 inch by 1 inch in size, nominally 1.0 millimeter thick. (These slides are available from Baxter Diagnostics, Inc. of McGaw Park, Ill.). In order to avoid sample slippage, which will invalidate test results, samples are bonded to these slides by the use of 3M Scotch-brand double-coated mylar tape #415. The tape is available from McCaster-Carr Supply Company of Chicago, Ill.). The samples are mounted by the following procedure:

1) Cut a test specimen with dimensions of 6.0 inches by 2.0 inches such that the longer dimension lies at an angle 45 degrees clockwise with respect to the machine direction of the test material when viewing the sample from the opposite side of the test side;
2) Cut a piece of tape slightly larger than the glass slide with a scissors;
3) Holding a glass slide in one hand, apply the cut tape to the slide starting at one edge and proceeding across the entire surface using a finger to slowly, but firmly, smooth the tape across the slide to avoid wrinkles, air pockets and other imperfections. Such imperfections are clearly visible by looking through the slide during the attachment of the tape. If the adhesive tape does not bond uniformly across the entire surface of the slide, discard the slide;
4) Place the test side of the specimen cut in step 1) down on a clean, smooth table. Peel the backing paper from the tape attached to the glass slide. Lightly press the adhesive covered side of the glass slide down onto the specimen, being sure that the long dimension of the slide is accurately aligned with the long dimension of the cut specimen;
5) After the sample is mounted, carefully cut away adhesive and specimen areas that protrude beyond the edges of the slide, using a razor knife;
6) Finally, inspect the specimen to ensure that no wrinkles or other deformations were caused during the mounting process. Any mounted specimens that show imperfections should be discarded.

Specimens are tested by placing the specimen slide on the translation table with the specimen side up. The slide is aligned so that its longer dimension parallels the probe scanning direction of the Surfanalyzer. It is positioned so that the Surfanalyzer stylus, when fully extended, is positioned about ¼ inch from the corner of the specimen slide, towards the center of the slide along the slide diagonal.

Data acquisition on the Signal Analyzer is started. The Surfanalyzer translation (scanning) motion is switched on and the translation table is started in the direction that moves the centerline of the slide towards the stylus tip. As soon as both motions begin, the Surfanalyzer stylus is adjusted vertically down onto the sample until the Signal Analyzer time domain display indicates that the signal trace is evenly split about the zero voltage level, indicating nominal centering of the stylus travel within its measurement range. After centering, a delay of 40 seconds is required so that all data acquired during stylus centering is passed from the Signal Analyzer memory. After 40 seconds, the cleared Signal Analyzer averager memory is switched on. The averager will run for 120 seconds of spectrum data acquisition, after which time the averager will automatically switch off, indicated by the extinguishing of a panel light. At this point, the translation table and Surfanalyzer translations are switched off and the stylus is raised off the specimen to allow the removal of the slide.

A precursor of the Surface Smoothness value is read off of the Signal Analyzer spectrum averager by integrating the average spectrum signal from 0.25 to 2.25 Hz using the "delta P" cursor mode. The "delta P" mode integrates the square of the displayed magnitude spectra to give the RMS "power" within the frequency range of interest. The output units are volts.

The numbers off the Signal Analyzer must be multiplied by the ratio of micro-inches of stylus displacement per volt of output of the Surfanalyzer to convert to units of micro-inches. When the Surfanalyzer is operated on the 200 micro-inch per division sensitivity range, the auxiliary output voltage represents 1600 micro-inches per volt. Therefore, the "delta P" value is multiplied by 1600 to convert the units from volts to micro-inches.

Since the mean translation speed of the probe is approximately 0.1 inches per second (the translation table velocity component being so low as to be of no consequence to the total velocity), the temporal frequency range of 0.25 Hz to 2.25 Hz corresponds to a spacial frequency of 2.5 to 22.5 cycles per inch. The Surface Smoothness value is therefore equivalent to the frequency partitioned standard deviation of the specimen surface profile between the frequencies of 2.5 and 22.5 cycles per inch.

In order to obtain meaningful test results, at least five, and preferably ten, specimens should be tested for each sheet sample side.

EXAMPLES

Example 1 (This invention)

In order to further illustrate the invention, an uncreped throughdried web was made using the method illustrated in FIG. 1. More specifically, an aqueous suspension of 100% secondary papermaking fibers was prepared containing about 0.2 weight percent fibers. The fiber suspension was fed to a Fourdrinier headbox and deposited onto the forming fabric. The forming fabric was an Asten 866 having a void volume of 64.5%. The speed of the forming fabric was 862 feet per minute. The newly-formed web was dewatered to a consistency of about 20 weight percent using vacuum suction from below the forming fabric before being transferred to the transfer fabric, which was traveling at a speed of about 750 feet per minute (15% differential speed). The transfer fabric was an Asten 959 having a void volume of 59.9%. A fixed gap of about 0.635 millimeter was initially provided between the forming fabric and the transfer fabric at the point of transfer at the leading edge of the transfer shoe, the fixed gap being slightly wider than the thickness of the wet web at that point in the process to allow for sheet expansion while transferring. A vacuum shoe pulling a vacuum of 5 inches of mercury was used to make the transfer without compacting the wet web. The web was then transferred to a 920A throughdrying fabric traveling at a speed of 750 feet per minute. The angle of convergence was about 0.5° and the angle of divergence was about 1°. The web was carried over a Honeycomb throughdryer operating at a temperature of about 350° F. and dried to final dryness (about 2 percent moisture). The resulting basesheet was wound into a softroll and exhibited the following properties: basis weight, 22 grams per square meter (gsm); geometric mean tensile strength, 2188 grams per 3 inches width (grams); and Surface Smoothness, 3110 micro-inches.

Example 2 (This invention)

An uncreped throughdried sheet was made as described in Example 1, except that the speed of the forming fabric was 810 feet per minute (8% speed differential). The resulting properties of the basesheet were as follows: basis weight, 21 gsm; geometric mean tensile strength, 1476 grams; and Surface Smoothness, 2390 micro-inches.

Example 3 (This invention).

An uncreped throughdried sheet was made as described in Example 1, except that the newly-formed sheet was hydroneedled to improve the absorbent wicking of the sheet.

The properties of the resulting sheet were as follows: basis weight, 22 gsm; geometric mean tensile strength, 1901 grams; and Surface Smoothness, 3210 micro-inches.

Example 4 (This invention)

An uncreped throughdried sheet was made as described in Example 2, except the newly-formed web was hydroneedled as previously described. The properties of the resulting sheet were as follows: basis weight, 21 gsm; geometric mean tensile strength, 1476 grams; and Surface Smoothness, 2390 microinches.

Example 5

For comparison, an uncreped throughdried sheet was made similarly as described in Example 1, but without a transfer fabric and without a fixed gap transfer. Instead, the transfer fabric was replaced with a typical throughdryer fabric (Asten 920A) and the differential speed relative to the forming fabric was 20% slower. The resulting web had the following properties: basis weight, 16 gsm; geometric mean tensile strength, 2056 grams; and Surface Smoothness, 3470 micro-inches. A repeat of Example 5 yielded a Surface Smoothness of 3360 micro-inches.

As shown by the previous Examples, the use of a transfer fabric as herein defined can produce a smoother sheet as evidenced by the Surface Smoothness.

It will be appreciated that the foregoing examples, given for purposes of illustration, are not to be construed as limiting the scope of the invention, which is defined by the following claims and all equivalents thereto.

We claim:

1. A method of making a cellulosic web comprising:

(a) depositing an aqueous suspension of papermaking fibers onto the surface of an endless traveling foraminous forming fabric to form a wet web having a consistency of from about 15 to about 25 percent;

(b) transferring the wet web from the forming fabric to a transfer fabric using a transfer shoe having a vacuum slot, said vacuum slot having a leading edge and a trailing edge, the leading edge being upstream of the trailing edge, wherein the forming fabric and the transfer fabric converge and diverge at respective angles at the leading edge of the vacuum slot, and wherein the transfer fabric is traveling at a speed of from about 5 to about 75 percent slower than the forming fabric and wherein the angles of convergence and divergence between the forming fabric and transfer fabric are about 0.5° or greater; and (c) transferring the wet web from the transfer fabric to a throughdrying fabric, whereon the web is noncompressively dried.

2. The method of claim 1 wherein the angles of convergence and divergence between the forming fabric and the transfer fabric are about 1° or greater.

3. The method of claim 1 wherein the angles of convergence and divergence between the forming fabric and the transfer fabric are about 2° or greater.

4. The method of claim 1 wherein the angles of convergence and divergence between the forming fabric and the transfer fabric are about 5° or greater.

5. The method of claim 1 wherein the angles of convergence and divergence between the forming fabric and the transfer fabric are from about 1° to about 10°.

6. The method of claim 1 wherein the transfer fabric is traveling at a speed of about 10 to about 35 percent slower than the forming fabric.

7. The method of claim 1 wherein the transfer fabric is traveling at a speed of about 15 to about 25 percent slower than the forming fabric.

8. The method of claim 1 wherein the transfer fabric is traveling at a speed of about 20 to about 25 percent slower than the forming fabric.

* * * * *